United States Patent [19]

Shinohara et al.

[11] Patent Number: 4,483,620

[45] Date of Patent: Nov. 20, 1984

[54] REGENERATIVE HEATING AND MELTING DEVICE FOR RECOVERED ASPHALT CONCRETE RUBBLE

[75] Inventors: Kunio Shinohara, Nishinomiya; Takeshi Kimura, Abiko, both of Japan

[73] Assignees: Kajima Road Co. Ltd.; Nihon Cement Co., Ltd., both of Tokyo, Japan

[21] Appl. No.: 555,923

[22] Filed: Nov. 29, 1983

Related U.S. Application Data

[63] Continuation of Ser. No. 374,589, May 3, 1982, abandoned.

[30] Foreign Application Priority Data

May 15, 1981 [JP] Japan ..... 56-72199

[51] Int. Cl.[3] ..... B28C 5/46

[52] U.S. Cl. ..... 366/7; 366/15; 366/25; 366/147; 366/290

[58] Field of Search ..... 366/4, 7, 14, 15, 25, 366/290, 291, 65, 66, 67, 24, 147, 144, 2, 6, 13, 22, 309; 34/173

[56] References Cited

U.S. PATENT DOCUMENTS

| | | | |
|---|---|---|---|
| 744,359 | 11/1903 | Klepetko | 366/290 |
| 1,879,897 | 9/1932 | Gernelle-Danloy | 366/291 X |
| 2,093,998 | 9/1937 | Colbert | 366/7 X |
| 2,882,149 | 4/1959 | Willems | 366/290 |
| 3,637,191 | 1/1972 | Abraham | 366/15 X |
| 4,189,238 | 2/1980 | Mendenhall | 366/7 |

*Primary Examiner*—Robert W. Jenkins

*Attorney, Agent, or Firm*—Beveridge, DeGrandi & Kline

[57] ABSTRACT

A regenerative heating and melting device is disclosed for treating asphalt concrete rubble for the recovery of an asphalt coated aggregate suitable for reuse. The apparatus includes a vertical cylindrical casing, an inlet for hot gas and an outlet for exhaust gas, conveyor means for conveying the rubble to the top of the casing and means for recovering the regenerated paving material from the casing. The internal space of the cylindrical casing is divided into a plurality of tier sections by partition plates. Each of the plates has an opening means to communicate with the adjacent lower tier section. A rotary shaft is provided in the cylindrical casing, the axis of which coincides with the axis of the cylindrical casing and extending through the tier sections and partition plates. The mixing blades are above and in sliding contact with the partition plates and of a dimension so that on the diameter, the diameter of the mixing blades is slightly less than the interior diameter of the casing to permit rotation of the mixing blades inside the casing with sufficient clearance to permit movement.

11 Claims, 7 Drawing Figures

REGENERATIVE HEATING AND MELTING DEVICE FOR RECOVERED ASPHALT CONCRETE RUBBLE

The application is a continuation of our copending application Ser. No. 374,589 filed May 3, 1982 now abandoned, the entire disclosure of which is relied on and incorporated herein.

This invention relates to a device for heating and melting the broken asphaltic concrete that occurs in redoing the asphalt concrete pavement of the road, in order to render the crushed concrete re-usable.

Such broken asphaltic concrete in the form of rubble results from stripping the existing asphalt concrete pavement. The rubble can be made use of as a back-filling material or a roadbed material but cannot be re-used as a pavement material in its as-stripped form. Many techniques of restoring it to its original mixture of asphalt cement and aggregates have been proposed.

According to the currently practice restorative technique, the asphaltic rubble is mechanically broken into smaller lumps or, by using hot water or steam, heated and melted into a proper range of lump sizes, or is finely crushed to the sizes of the original aggregate and then heated in such as a drum drier to make it free of water.

The drawback of these known techniques is that the equipment for implementing them is necessarily large in size and complex in construction because the rubble must be crushed to the original aggregate size and heated with hot water or steam, and that, in the case of melting by heating, a large amount of energy has to be expended in removing the water by evaporation.

The object of the present invention is to provide a simple and compact means of heating the broken asphalt concrete rubble and melting the asphalt to thereby obtain a re-usable form of aggregate coated with asphalt without involving expenditure of a large amount of energy.

The invention also provides a method for the regenerative heating and melting of crushed recovered asphalt concrete rubble.

According to this invention, the mechanical and thermal actions are effected concurrently on the rubble inside the device of this invention in such a manner as to minimize the deterioration of asphalt cement in the rubble and to heat it to the temperature desired for its re-use as a pavement material.

How the present invention accomplishes its object will be seen in the following description of examples of the device of this invention illustrated in FIGS. 1 through 7 given in the accompanying drawings:

FIG. 4 is a cross-section taken at line IV—IV of FIG. 3;

FIG. 5 is a cross-section taken at line V—V; and

FIGS. 6 and 7 show the configuration of mixing blades in plan view.

The method of the invention is for the regenerative heating and melting of recovered asphalt concrete rubble, wherein crushed asphalt concrete rubble is conveyed to a housing; i.e. the cylindrical casing, where it is subjected to hot gas with agitation. The heated rubble moves downwardly in the housing during the heating step. The hot gas may move in the same direction as the rubble; i.e. concurrent, or it may be countercurrent. In the course of this movement, the old asphalt is melted and the aggregate becomes coated with soft asphalt. The result is a soft state regenerated hot paving material which is ready for deposition to the road surface.

Figure 1:
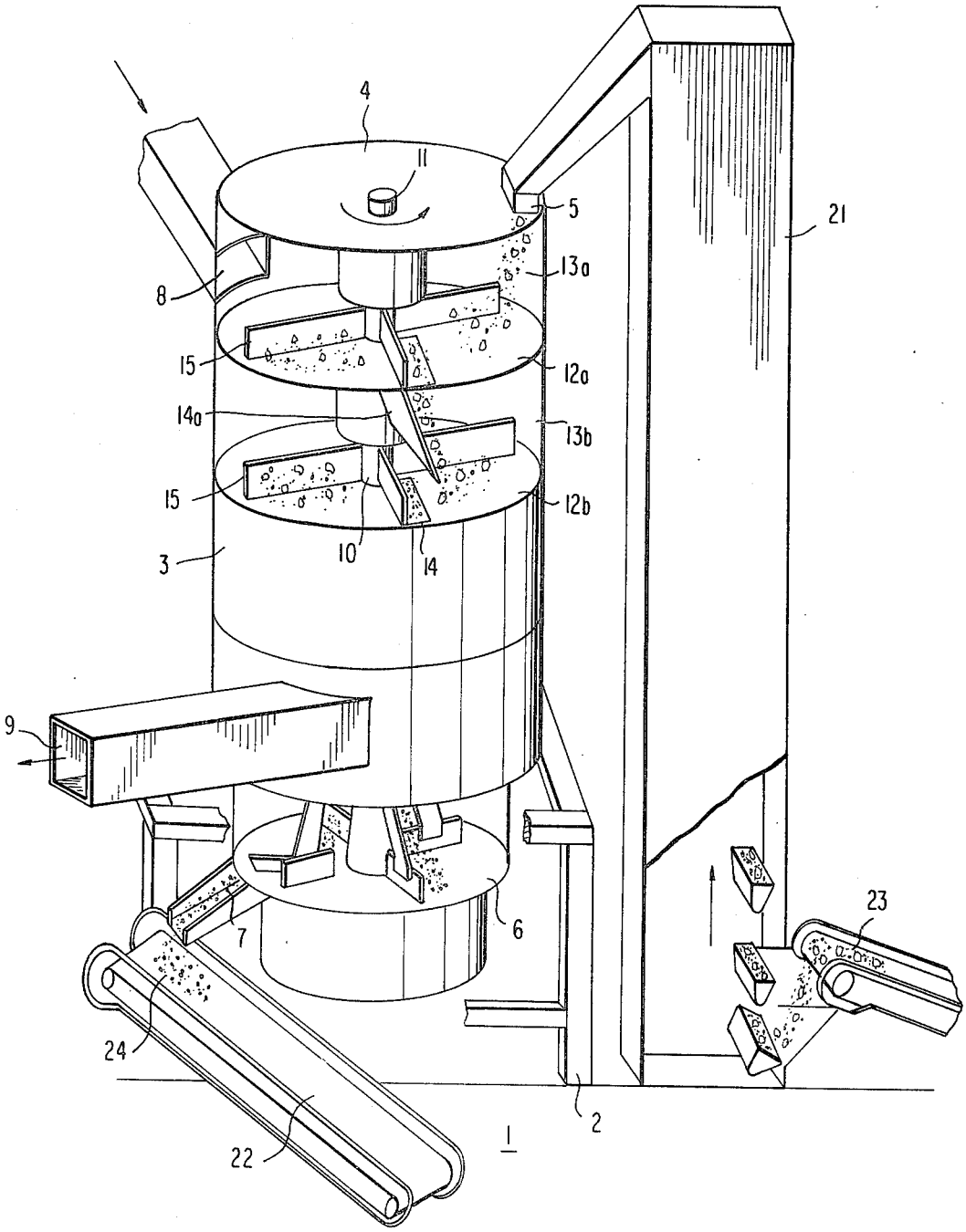
FIG. 1 is an isometric view of the apparatus of the invention.

Referring to FIG. 1 showing one of the examples, support frame 2 is solidly set on ground surface 1. On the frame is rigidly mounted cylindrical casing 3, whose top plate 4 is complete with an opening serving as rubble inlet 5 and whose bottom plate 6 is complete with an opening serving as regenerated material outlet 7. In the cylindrical wall of casing 3, near top plate 4, has an opening serving as hot-gas inlet 8 for connection with a hot-gas supply duct. Near bottom plate 6, the cylindrical wall has an opening to which exhaust gas outlet duct 9 is connected.

Rotary shaft 10, whose axis coincides with that of cylindrical casing 3, is provided inside the casing and is supported by bearings 11, one being fitted to top plate 4 and the other to bottom plage 6. (See FIG. 2).

The space inside cylindrical casing 3 is divided into a plurality of tier sections 13*a*, 13*b*, 13*c*, 13*d*, 13*e* and so on, by means of partition plates 12*a*, 12*b*, 12*c*, 12*d*, 12*e* and so on. (Except when a specific partition plate is indicated, all plates will be referred to by number 12.) (Similarly, all tier sections will be referred to by number 13.) Two adjacent tier sections 12 are communicated to each other through communicating hole or opening 14 formed in partition plate 12 between the two sections. Guide plate 14*a* is attached to the underside of all plates and serves to guide the filling rubble onto the next plate below. The guide plate is arranged to deposit the filling rubble away from the hole 14 in that plate. The hole 14 in each position in FIG. 1 is located in line with the corresponding hole in adjacent plates, as shown. However, the holes may also be offset. The holes are generally of the same size. In each tier section, a plurality of mixing blades 15 extend radially from rotary shaft 10, the blades being integral with the shaft and being so shaped that, as shaft 10 rotates, blades 15 revolve in sliding contact with partition plate 12. As is shown in FIG. 1, the mixing blade 15 has a diameter slightly less than the inside diameter of the casing to permit rotation inside the casing with sufficient clearance to permit movement without any impediment.

The materials which are dropped on the partition plate are moved by mixing blade 15 in a circular pass approximately slightly less than 360 degrees whereupon the materials then drop to the underside plate through the hole.

Figure 2:
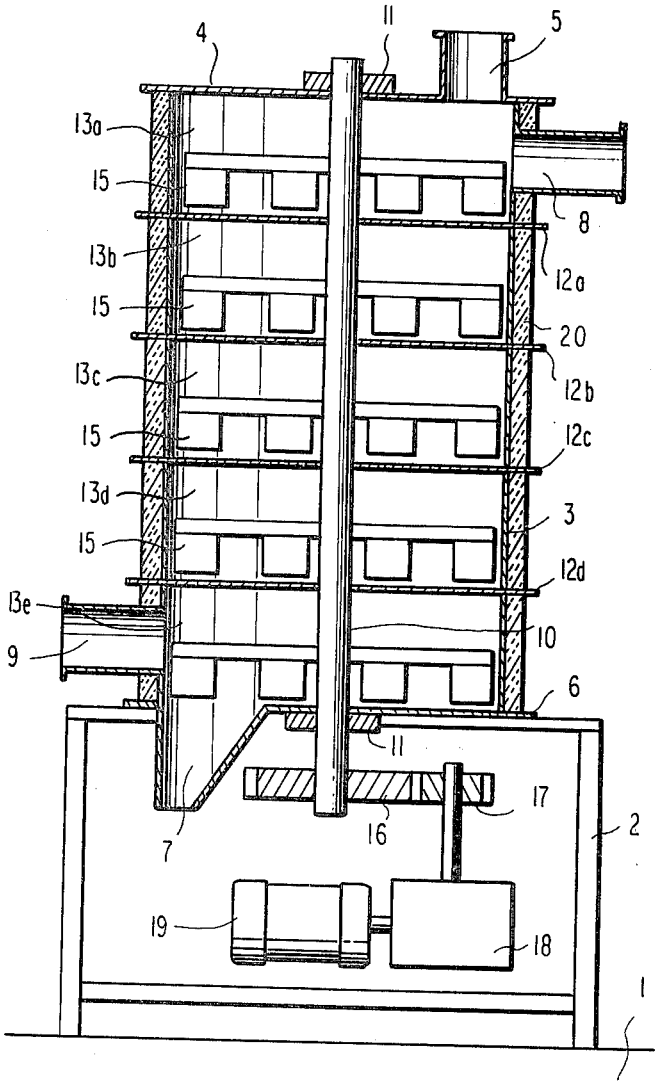
FIG. 2 is a sectional elevation view of another embodiment of the apparatus of the invention.

FIG. 2 shows that the bottom end of rotary shaft 10 is secured to gear 16, which is in mesh with gear 17 mounted on the output shaft of speed reducer 18. Reducer 18 is coupled to electric motor 19 to continuously drive shaft 10 through gears 17 and 16. Instead of this arrangement, any other known means of drive may be used.

The external surface of cylindrical casing 3 is preferably covered with insulation material 20 to minimize heat loss. To said rubble inlet 5 and regenerated material outlet 7 are connected rubble feeding means 21 and regenerated material conveying means 22, respectively, in that order and as shown in FIG. 1.

The device arranged and constructed as above is started up for operation by starting up the blower, not shown, connected to exhaust gas outlet duct 9 and then starting up the hot-gas supply source, now shown, or, for example, a hot-gas furnace. The chemical composition of the gas is not critical and will be known to persons skilled in the art. The temperature of the hot gas at inlet 8 should be anywhere between about 500° C. and 600° C. With hot gas being supplied and exhaust gas being drawn out, motor 19 is to be started up to drive rotary shaft 10 through reducer 19 and gears 17 and 16, thereby setting mixing blades 15 in revolving motion. When the temperature of exhaust gas has risen to about 200° C., rubble feeder 21 is to be started to feed rubble 23 through inlet 5. The desired average lump size of rubble 23 is about 80 mm but any lump size will do as long as the rubble is suitable for being handled by feeder 21. The rubble need not be broken into lumps and sifted for sizing prior to feeding; broken asphalt concrete in melted form consisting of aggregates not bound by asphalt cement may be fed into the casing. The crushed rubble is about 80 mm or less, and preferably 40 mm or less and not preferably less than 20 mm in diameter.

Rubble 23 fed into the top tier section falls onto partition plate 12*a* and is then pushed around by mixing blades 15 to enter by gravity into the next section through communicating hole 14. This process is repeated to forward rubble 23 downward through successive tier sections 13*b*, 13*c*, 13*d*, 13*e* and so on. During this process, rubble 23 is exposed to the hot gas, which melts the asphalt cement, and the agitating action of mixing blades 15 separates the pieces of aggregates, so that the rubble becomes transformed into regenerated paving material 24, which comes out of outlet 7 with a temperature between 150° C. and 170° C. Since the rotating speed of shaft 10 can be adjusted as desired by means of speed reducer 18, the temperature with which regenerated paving material 24 comes out can be controlled by varying the speed of shaft 10 to control the duration of each portion of the rubble remaining inside the cylindrical casing. Generally, the speed of the shaft is from 2 to 5 rpm.

Referring to FIG. 2 showing the other example, blades 15 differ from those of FIG. 1 and, accordingly, the location of communicating hole 14, too, differs, as will be explained later. With respect to all other features, the device shown in FIG. 2 is substantially the same as that shown in FIG. 1.

Figure 3:
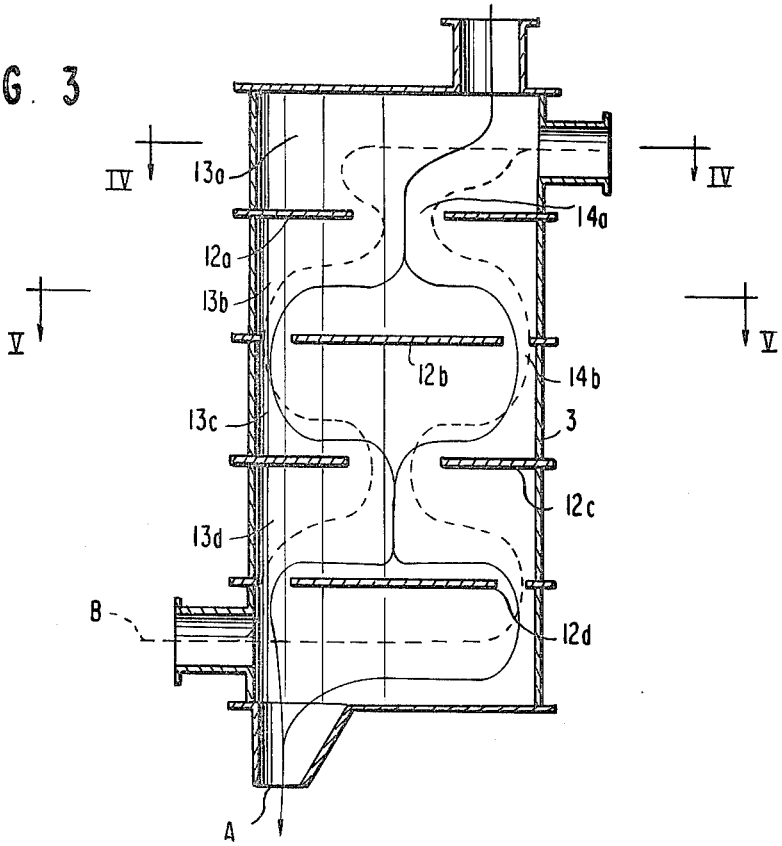
FIG. 3 is a sectional schematic view of the apparatus shown in FIG. 2 and illustrates its operation.
Figure 4:
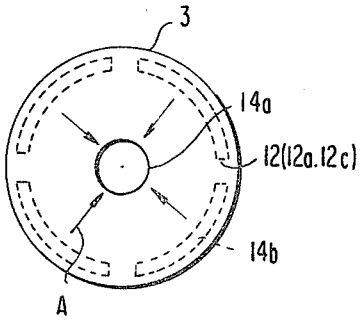
FIGS. 4 to 7 are plan views of the tier constructions inside the apparatus of the invention, as follows.
Figure 5:
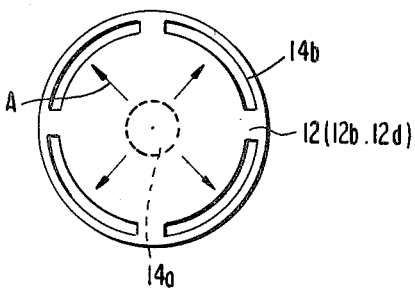

FIGS. 3, 4 and 5 serve to describe the example illustrated in FIG. 2. Note that communicating hole 14*a* is formed of partition plates 12*a* and 12*c* and is located around rotary shaft 10 (not shown), the hole being concentric with cylindrical casing 3. On the other hand, communicating hole 14*b* is formed of partition plates 12*b* and 12*d*, the hole being located alongside of the cylindrical wall of the casing.

From top to bottom, communicating holes 14*a* and 14*b* alternate: if partition plate 12*a* forming uppermost tier section 13*a* is given hole 14*a*, as shown, then partition plate 12*b* forming the next tier section 13*b* has hole 14*b*. How these concentrically located communicating holes are to be formed of partition plates is shown in FIGS. 4 and 5, in which (as seen from top side) the communicating hole of the plate immediately below is indicated in dot lines. In FIGS. 3, 4 and 5, arrows A in real lines indicate the direction of rubble flow and arrows B in broken lines indicate the direction of hot-gas flow. In the illustrated example, rubble and hot gas flow in the same direction, that is, parallel directions. In the case of counter-flow arrangement with the hot gas supplied into the bottom part of cylindrical casing 3, broken-line arrows B reverse the direction and point upward.

Figure 6:
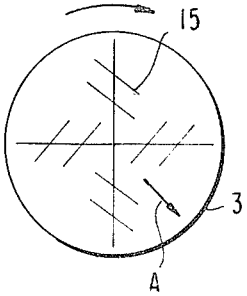
Figure 7:
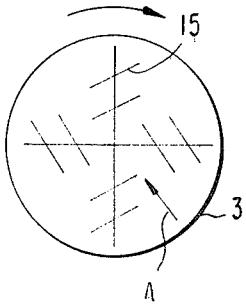

Mixing blades 15 may be shaped and designed as desired to suit the purpose, and their configuration too may be determined as desired. FIGS. 6 and 7 shows the configurations of blades 15 that are applicable to the example of FIG. 2. In the configuration of FIG. 6, the rubble flows radially outward from the center area, as indicated by arrow A; in the configuration of FIG. 7, the rubble flows radially inward as indicated by arrow A. Thus, the path of rubble flow indicated by arrows A in FIGS. 3, 4 and 5 can be set by selectively determining the installed position of mixing blades 15 to suit the positions of communicating holes 14 (14*a* and 14*b*).

It will be seen from the foregoing description that this invention provides a simple device in which the regenerated paving material of a desired temperature can be obtained through a single process and, at the same time, the deterioration of asphalt cement resulting from the melting of the rubble can be minimized. Specifically, the mechanical and thermal actions on the recovered asphalt concrete rubble can be concurrently and effectively effected so that, even when the as-fed rubble is in large lump sizes (of about 80 mm), the single-process heating and melting in the device of this invention transforms the rubble into the regenerated paving material in which the aggregates are in original sizes.

It should be noted that the product discharged from the apparatus of the invention is discharged in the hot state and therefore is ready to use on the road building site. The device of the invention is therefore a portable apparatus which can be moved from site to site as needed. Fresh asphalt can be added in the lowest mixing chamber if desired.

We claim:

1. A regenerative heating and melting device for treating asphalt concrete rubble to recover an asphalt coated aggregate suitable for reuse, comprising a vertical cylindrical casing having an upper portion and a lower portion, said casing being provided with a hot-gas inlet and an exhaust gas outlet whereby heat may be added to the upper portion of the casing, or added to the lower portion of the casing, and an outlet provided in the bottom portion of said casing, the internal space of said cylindrical casing being divided into a plurality of tier sections by partition plates, each of said plates having a diameter conforming generally to the internal diameter of said cylindrical casing, at least one of said plates having a communicating opening to communicate with the adjacent tier sections, a rotary shaft provided within the cylindrical casing and extending through said tier sections and partition plates, mixing blades mounted on and revolving with said rotary shaft in said tier sections above and in sliding contact with said partition plate to thereby enable the recovery of an asphalt coated aggregate suitable for reuse, said mixing blades being of a dimension so that, on the diameter, the dimension is slightly less than the inside diameter of the casing to permit rotation of the mixing blades inside the casing with sufficient clearance to permit movement.

2. The device of claim 1, wherein a plurality of partition plates each has an opening therein and each opening has underneath it a guide plate for aiding in deposition of rubble onto the partition plate immediately there beneath.

3. The device of claim 1, wherein each partition plate has mixing blades mounted thereon.

4. The device of claim 1, wherein the mixing blades are four in number and are arranged to create acrs of 90° each.

5. The device of claim 1, wherein the mixing blades are arranged to cause the rubble to flow to the center of the partition plate.

6. The device of claim 1, wherein the opening is located at the center of the partition plate.

7. The device of claim 1, wherein the opening is located at the periphery of the partition plate.

8. The device of claim 1, wherein the mixing blades are arranged to cause the rubble to flow to the periphery of the plate.

9. A method for the regenerative heating and melting of recovered asphalt concrete aggregate rubble, comprising conveying crushed asphalt concrete rubble to a vertically oriented housing, heating said rubble in hot gas with agitation, wherein the rubble moves downwardly in the vertical housing during the heating step, in contact with hot gas in the course of said agitation and downward flow of the rubble, the asphalt in the rubble is melted and the aggregate becomes coated with soft asphalt to thereby generate a soft state regenerated hot paving material ready for deposition onto a surface.

10. The method of claim 9, wherein the hot gas flow is countercurrent with regard to the movement of the rubble.

11. The method of claim 9, wherein the hot gas flow is concurrent with respect to the movement of the rubble.

* * * * *